United States Patent [19]

Weber

[11] Patent Number: 5,074,338

[45] Date of Patent: Dec. 24, 1991

[54] TRAVELLING PNEUMATIC CLEANER FOR MOVING MACHINE MEMBERS

[75] Inventor: Fred Weber, Schaffhausen, Switzerland

[73] Assignee: AGM Aktiengesellschaft Müller, Neuhausen am Rheinfall, Switzerland

[21] Appl. No.: 526,006

[22] Filed: May 21, 1990

[30] Foreign Application Priority Data

May 30, 1989 [CH] Switzerland ..... 02019/89

[51] Int. Cl.[5] ..... D03J 1/00

[52] U.S. Cl. ..... 139/1 C; 15/312.1; 55/294

[58] Field of Search ..... 15/312.1, 316.1; 139/1 C; 55/294

[56] References Cited

U.S. PATENT DOCUMENTS

| | | | |
|---|---|---|---|
| 1,447,418 | 3/1923 | Kenney et al. | 15/312.1 X |
| 2,845,303 | 7/1958 | King, Jr. | 15/312.1 X |
| 2,884,011 | 4/1959 | Littlejohn et al. | 139/1 C |
| 3,004,277 | 10/1961 | Allred | 15/312.1 |
| 3,571,840 | 3/1971 | Gleaton et al. | 15/312.1 |
| 3,945,081 | 3/1976 | Cook et al. | 15/312.1 |
| 4,510,845 | 4/1985 | Kagi | 91/180 |
| 4,697,298 | 10/1987 | Mulligan | 15/312.1 |
| 4,869,296 | 9/1989 | Shaw | 139/1 C |

*Primary Examiner*—Andrew M. Falik

*Attorney, Agent, or Firm*—Spencer & Frank

[57] ABSTRACT

The travelling cleaner for looms and such machines with rows of moving machine members comprises a compressed-air blower guided to and fro along the row of moving machine members, the compressed-air blower is disposed on a compressed-air linear motor which is movable to and fro along a guide attached to the loom supporting the row of moving loom members, and the compressed-air blower and the compressed-air linear motor are connected to a mutual compressed-air source. This renders possible for the first time, a fully-automatic, optimal cleaning of rows of moving loom or machine members on any desired loom or machine of this kind.

3 Claims, 1 Drawing Sheet

TRAVELLING PNEUMATIC CLEANER FOR MOVING MACHINE MEMBERS

BACKGROUND OF THE INVENTION

The present invention relates to a device for removing contaminating particles such as dust and lint deposits settling on rows of moving machine members, in particular textile-industry machines such as Jacquard looms and similar machines.

In many production machines comprising moving machine members disposed in long rows, like, for instance, Jacquard looms, by which great numbers of warp threads are each connected by means of strings to the notched bars of the loom which receive the motion thereof from the harness, the harness strings being connected by strands which take up the warp threads, the problem of contamination exists due to settling dust or lint, which quickly leads to disturbances on the loom.

In order to keep such disturbances in bounds, attempts are often made to clean such endangered areas manually by means of a compressed-air hose. Such operations are, of course, quite insufficient and stand as a hindrance in the way of an automation that is aimed at.

SUMMARY OF THE INVENTION

Therefore, a primary object of the present invention is to create a device for removing contaminating particles such as dust and lint deposits settling on rows of moving machine members, in particular textile-industry machines such as Jacquard looms and similar machines, which allows a full automation at optimum cleaning capacity, greatest economy and universal applicability and the capability of being subsequently equipped.

This is achieved according to the invention by a compressed-air blower guided to and fro along the row of moving loom or machine members.

In this connection, an advantageous development of the invention exists therein that the compressed-air blower is disposed on a compressed-air linear motor which is movable to and fro along a guide attached to the loom supporting the row of moving loom members.

Furthermore, it is of advantage that the compressed, air blower comprises several Venturi tubes which are disposed one above the other, wherewith it is expedient that the Venturi tubes disposed one above the other are vertically adjustable or tiltable in such a manner that the cones of air thereof intersect in the region of the moving loom members.

Such a device meets all the aforementioned conditions and is, moreover, extremely economical in energy consumption, which can be further improved thereby that the compressed-air blower and the compressed-air linear motor are connected to a mutual compressed-air source.

BRIEF DESCRIPTION OF THE DRAWING

Embodiment examples according to the invention will now be described more particularly with reference to the accompanying drawings, wherein.

DETAILED DESCRIPTION OF THE PREFERRED EMBODIMENTS

Figure 1:
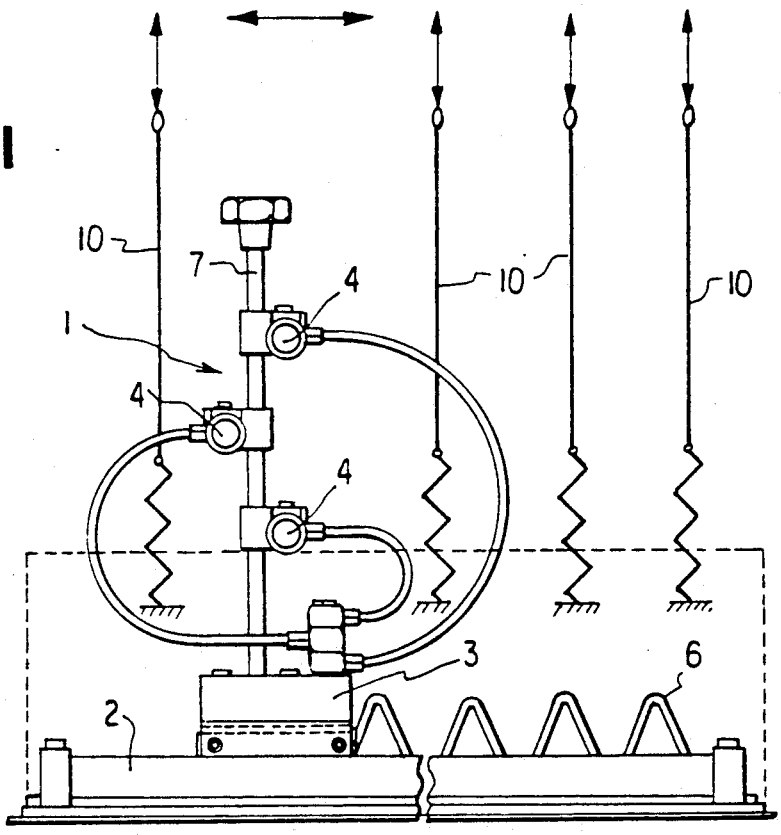
FIG. 1 shows in diagrammatic representation, a front view of the device according to the invention for removing contaminating particles on moving loom members.
Figure 2:
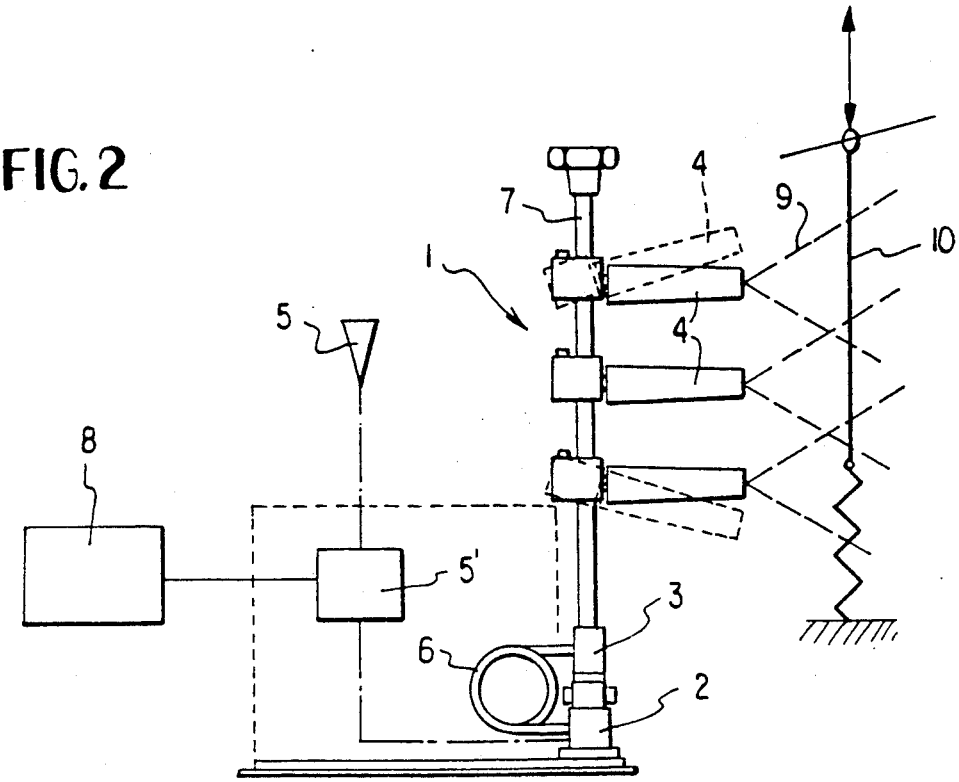
FIG. 2 shows in front-side view, the arrangement according to FIG. 1.

The device according to the invention for removing settling, contaminating particles, comprises a guide 2 for a compressed-air blower 1 guided to and fro along a row of loom members, such as schematically shown strands 10, for which the guide 2 has a suitable length and is capable of being mounted on the frame of the loom concerned.

Since, as previously mentioned, the travelling cleaner device according to the invention is suitable for every kind of loom that comprises at least one row of moving loom members, further reference concerning such a loom is redundant as it is not essential to the invention.

Advantageously, the compressed-air blower 1 as well as a compressed-air linear motor 3 supporting said blower are fed by a pneumatic hose 6 from a mutual compressed-air source 5, which, for example, may be a compressor of the loom itself or an air connection fed from a distance. The compressed-air linear motor 3 may be an apparatus as disclosed in U.S. Pat. No. 4,510,845, issued Apr. 16, 1985. Such apparatus is propelled by virtue of camming action between a cam track (feed rack) defining a travel path for the motor and a set of fluid-driven reciprocating stepping elements.

Suitable distributor means 5' as well as operating-mechanism means 8, if required also timer and/or reversing means (not shown in detail), control, thereby, fully automatically and appropriately programmable the reciprocating motion of the linear motor 3 as well as the action of the compressed-air blower 1, depending on the spacing of the loom members to be cleaned, if necessary the repetition frequency, length of guide 2, strength of existing compressed air and the like.

Of advantage is that the compressed-air blower 1 is equipped with an air emitting mechanism, such as several Venturi tubes 4 which are mounted one above the other on a column 7 of the linear motor 3 and which are vertically adjustable and/or tiltable in such a manner that the cones of air thereof intersect in the region of the moving loom members, such as the strands in FIG. 1, so that also elongated loom members, such as strands, strings, springs and the like, are able to be freed effectively and completely of settling, contaminating particles.

Such a device according to the aforementioned steps can meet the cleaning requirements automatically, economically, universally and optimally.

While there are shown and described preferred embodiments of the invention, it is to be distinctly understood that the invention is not limited thereto but may be embodied and practised within the scope of the following claims.

What I claim is:

1. A device for removing contaminating particles from a row of moving machine members, comprising (a) a guide extending along the row of moving machine members;

(b) a compressed-air motor mounted on said guide for travel thereon;

(c) a compressed-air blower mounted on said compressed-air motor for being carried thereby along the row of moving machine members; said compressed-air blower including an air emitting mechanism oriented toward the machine members;

(d) a common compressed-air source; and (e) means for connecting said compressed-air motor and said compressed-air blower to said common compressed-air source.

2. The device for removing contaminating particles as defined in claim 1, wherein the air emitting mechanism comprises several vertically spaced Venturi tubes.

3. The device for removing contaminating particles as defined in claim 3, comprising means for adjusting the Venturi tubes in a vertical direction such that cones of air thereof intersect in a region of the moving machine members.

* * * * *